United States Patent [19]

Kennedy

[11] Patent Number: 4,495,730

[45] Date of Patent: Jan. 29, 1985

[54] AUTOMATIC FARM GATE

[76] Inventor: James R. Kennedy, Box 169, Page, Nebr. 68766

[21] Appl. No.: 528,614

[22] Filed: Sep. 1, 1983

[51] Int. Cl.[3] ..... E05D 7/06

[52] U.S. Cl. ..... 49/280; 49/358; 49/394

[58] Field of Search ..... 49/358, 280, 340, 394, 49/302, 300

[56] References Cited

U.S. PATENT DOCUMENTS

| | | | |
|---|---|---|---|
| 2,589,480 | 3/1952 | Curtis | 49/280 X |
| 2,746,745 | 5/1956 | Damon | 49/280 X |
| 3,500,585 | 3/1970 | Vollmar | 49/340 X |
| 4,330,958 | 5/1982 | Richmond | 49/340 X |

FOREIGN PATENT DOCUMENTS

| | | | |
|---|---|---|---|
| 2312634 | 12/1976 | France | 49/340 |

*Primary Examiner*—Philip C. Kannan

*Attorney, Agent, or Firm*—Zarley, McKee, Thomte, Voorhees & Sease

[57] ABSTRACT

A remote control automatic gate assembly includes a hinged gate having a drive motor and track constructed on the gate itself with a sliding trolley connected to an adjacent post by a normally fixed length control arm. An automatic latching mechanism is provided which is operative in responsive to overtravel retracting movement of the trolley. The overtravel retracting movement of the trolley is taken up by slack adjustment mechanism to enable the gate to remain in its closed position during latching and unlatching of the gate.

11 Claims, 10 Drawing Figures

AUTOMATIC FARM GATE

BACKGROUND OF THE INVENTION

The present invention is directed generally to a remote control gate and more particularly to a self-latching automatic gate wherein the motor and drive elements thereof are mounted on the gate itself at an elevated position so as not to be bumped and damaged by farm or ranch animals.

The manual closing and opening of farm gates, for example, is time-consuming and incovenient for one desiring to pass through the gate in an automobile or truck or on horseback. Accordingly, it is desirable to provide a farm gate which is adapted to be opened and closed with a remote control switch much like an automatic garage door opener.

Automatic gates have previously been provided wherein the swinging motion of the gate is controlled by a powerized control arm. These may be either substantially extendable and retractable or they may have a bending joint in them. The former are expensive to manufacture and repair and the latter are particularly susceptible to damage when bumped by livestock, for example. Furthermore, the electric motor and controls of such devices are mounted on the control arm where they also are exposed to being bumped and damaged by livestock passing through the gate.

Hall, U.S. Pat. No. 2,592,891 shows a screw operated variable length control arm and Vollmar U.S. Pat. No. 3,500,585 also shows a control arm, the length of which is varied by moving it axially through the motor housing. In both, the motor is supported on the control arm.

Accordingly, it is a primary object of the invention to provide an improved automatic gate assembly.

Another object is to provide an automatic gate, the closing and opening movements of which are controlled by a substantially fixed length control arm.

Another object is to provide an automatic gate assembly wherein the motor and drive controls are mounted on the gate itself and at an elevated position.

Another object is to provide an automatic gate assembly which is automatically self-latching in its closed position.

Another object is to provide an improved automatic gate assembly which is simple in construction, durable and efficient in operation and economical to manufacture.

These and other objects are resolved by the automatic gate assembly of the present invention.

SUMMARY OF THE INVENTION

The automatic gate assembly of the present invention includes an elongated gate hingedly supported at one end and having an elongated track means extended along the upper edge thereof for supporting a longitudinally movable trolley thereon. A motor housing is also supported on the gate itself with a motor and drive means therein for advancing and retracting the trolley in opposite directions along the track means.

A control arm post is secured to the ground at a position in spaced relation from the plane of the gate when in its closed position. An elongated control arm has one end pivotally connected to the trolley and the opposite end pivotally connected to the control arm post such that the gate is constrained to swing to its open position in response to advancing movement of the trolley to a gate open position, and to swing to its closed position in response to retracting movement of the trolley to a gate closed position.

The gate has a latch movably supported thereon and a linkage operative for moving the latch to its latched position when the gate is closed. The linkage connection automatically latches the gate in response to overtravel retracting movement of the trolley beyond its gate closed position. A slack adjustment means takes up the overtravel retracting movement of the trolley so that the gate will reamin in its closed position while being latched and without binding movement of the control arm.

The automatic gate assembly of the present invention is substantially self-contained having the motor and track means supported on the gate itself and at an elevated position to avoid being bumped and damaged by livestock passing through the gate. The drive motor is adapted for remote control operation so that the gate can be opened by the press of a button from up to 100 feet away from the gate. The present invention thus provides a time-saving convenience both for motor vehicle operators and for riders on horseback. The automatic gate assembly is readily adaptable for use as a security gate or sorting gate. It may be used for confinement along fences, in corrals or on driveways.

BRIEF DESCRIPTION OF THE DRAWINGS

FIG. 6 is an enlarged partial detail view of the latching mechanism;

DESCRIPTION OF THE PREFERRED EMBODIMENT

Figure 1:
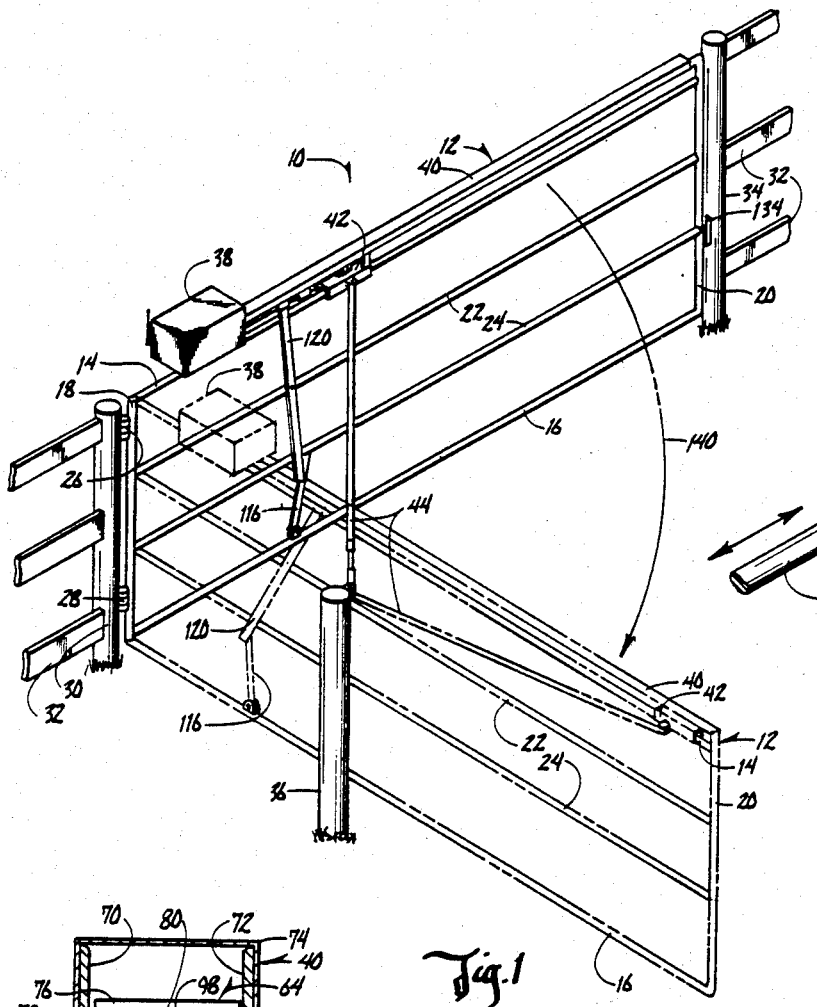
FIG. 1 is a perspective view of the automatic gate assembly with the open position of the gate indicated in dotted lines.

The automatic gate assembly 10 of the present invention is shown in FIG. 1 as including an elongated hinged gate 12 having a top rail 14, bottom rail 16, end posts 18 and 20 and intermediate rails 22 and 24. End post 18 is supported by hinges 26 and 28 on a ground secured upright hinge post 30 which may be part of a rail fence as indicated at 32.

Gate 12 is pivotally movable between its closed position shown in solid lines in FIG. 1 and an open position indicated in dotted lines in FIG. 1. An upright closure post 34 is secured in a position adjacent gate end post 20 when the gate is in its closed position. Another upright control arm post 36 is secured in the ground at a position in spaced relation from the plane of the gate in its closed position. For the usual 14 or 16 foot long gate, the control arm post is preferably positioned four feet outwardly from hinge post 30 and 30 inches back in a longitudinal direction away from gate 12.

A motor housing 38 and elongated track 40 are supported on gate 12 above top rail 14 for supporting and driving a trolley 42 longitudinally along track 40. An elongated control arm 44 has one end pivotally connected to the trolley 42 and an opposite end pivotally connected to the control arm post 36. Accordingly, gate 12 is constrained to swing to its dotted line open position in FIG. 1 in response to advancing movement of the trolley away from motor housing 38 to its dotted line gate open position in FIG. 1. Likewise, gate 12 is constrained to swing to its solid line closed position in FIG. 1 in response to retracting movement of the trolley to a gate closed position.

Figure 2:
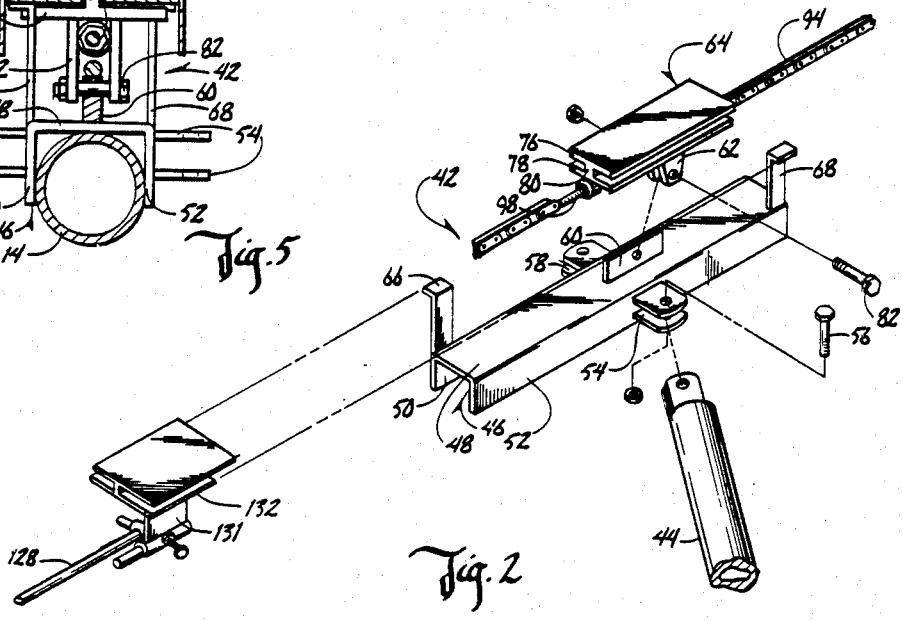
FIG. 2 is an exploded perspective view of the trolley and latch slide.

Trolley 42 is shown in FIG. 2 as an open bottomed channel 46 having a top wall 48 and depending flanges 50 and 52. A pair of clevis ears 54 extend outwardly from flange 52 for pivotal connected to control arm 44 by bolt 56. A similar pair of clevis ears 58 are provided on flange 50 for use on a gate which is adapted to be opened in the opposite direction of that shown in FIG. 1. An upright longitudinally extended mounting flange 60 on top wall 48 is adapted for pivotal connection to a depending clevis 62 on the underside of a trolley slide 64. Finally, a pair of upstanding inverted L-shaped tabs 66 and 68 extend upwardly from opposite ends of the trolley for abutment against the underside of the track 40 to prevent pivotal movement of trolley 42.

Figure 5:
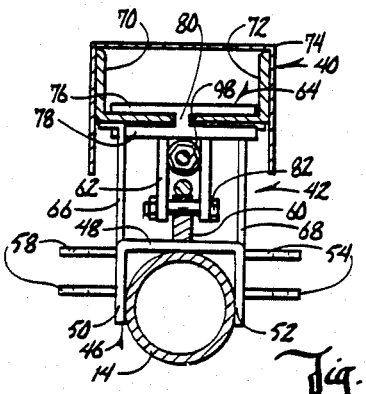
FIG. 5 is an enlarged detail end view of the trolley and track on which it is movably supported.

FIG. 5 shows that track 40 is formed as a pair of channel members 70 and 72 positioned with their lower horizontal flanges arranged in clearance relation. An inverted U-shaped track shield 74 is fitted over the top of channel 70 and 72 to shield them from moisture, dirt and the like.

Trolley slide 64 is a generally H-shaped member including parallel top and bottom flanges 76 and 78 interconnected by a central web 80 which fits into the clearance space between track channel 70 and 72 as shown in FIG. 5. Depending clevis ears 62 on bottom flange 78 are pivotally connected to the trolley mounting flange 60 by bolt 82.

Figure 4:
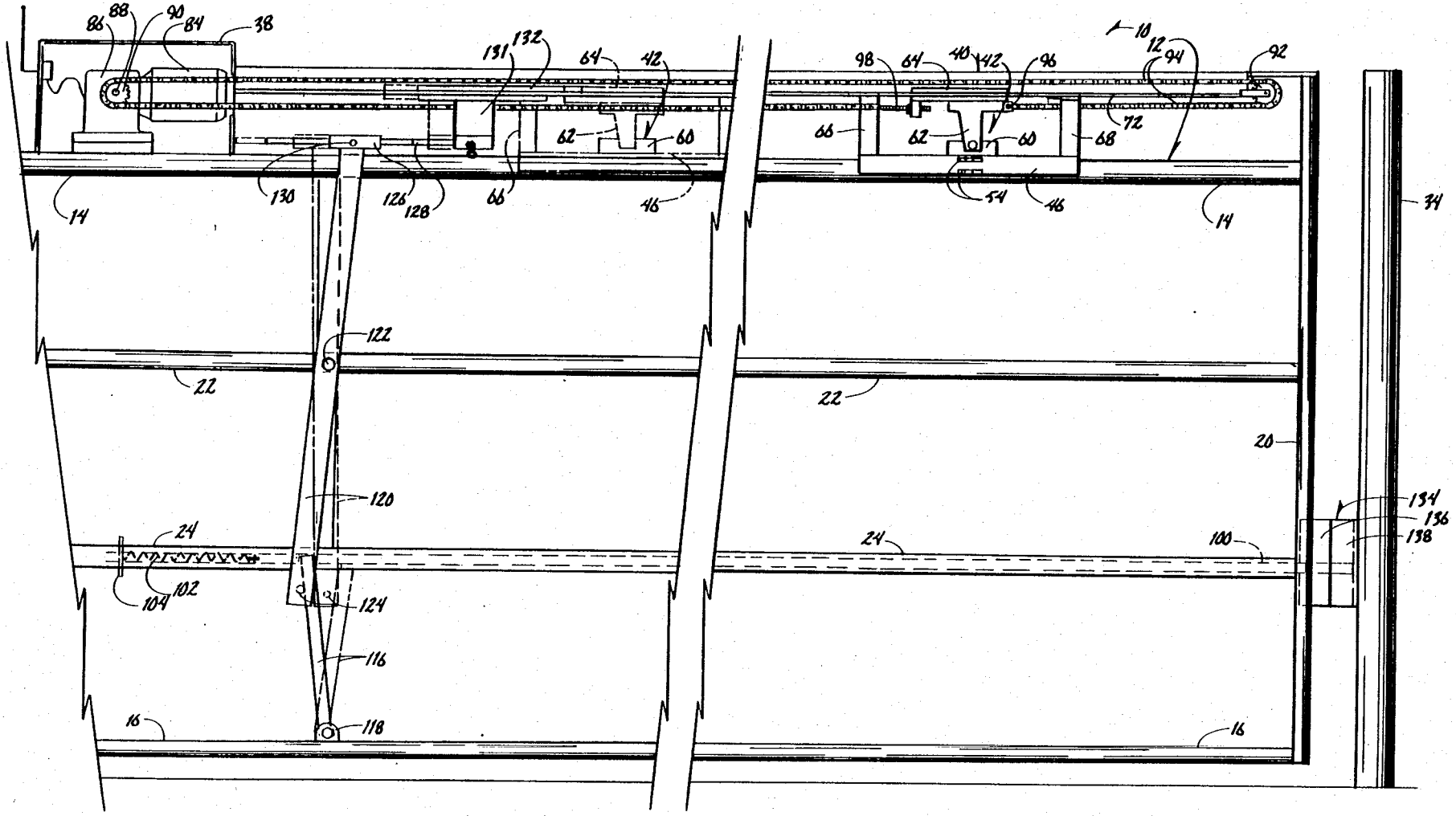
FIG. 4 is a foreshortened front elevational view of the gate with dotted lines indicating moved positions for the trolley and latching mechanism.

The drive means for trolley slide 64 is shown in FIG. 4. An electric motor 84 is supported within motor housing 38 on a gear block 86 having an output shaft 88 on which a drive sprocket 90 is mounted. An idler sprocket 92 is rotatably mounted at the opposite end of track 40 as shown in FIG. 4. A drive chain 94 is trained about both sprockets and has its opposite ends connected to the trolley slide 64 as indicated at 96 and 98 respectively. Connection 98 includes a slack adjustment screw for adjusting the desired tension in chain 94. Accordingly, reversible electric motor 84 is operative to advance trolley slide 64 toward end post 20 for opening the gate and to retract trolley slide 64 back toward motor housing 38 for closing the gate.

A latching mechanism is provided for securing the gate in its closed position. The latching mechanism includes an elongated latch bar 100 slidably supported within intermediate gate rail 24 as shown in FIG. 4. An opening is provided in the gate end post 20 to allow passage of the free end of latch bar 100 outwardly therethrough. The inner end of latch bar 100 is engaged by a tension spring 102 which is anchored to gate rail 24 by pin 104 for urging the latch bar 100 to its unlatched position.

Figure 6:
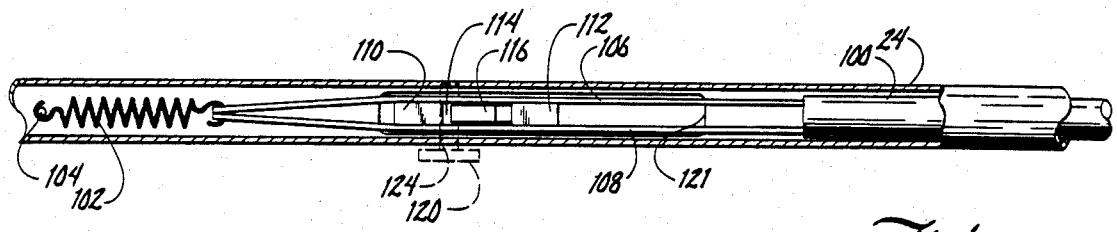
FIG. 6 is an enlarged top view of one end of the latch bar.
Figure 7:
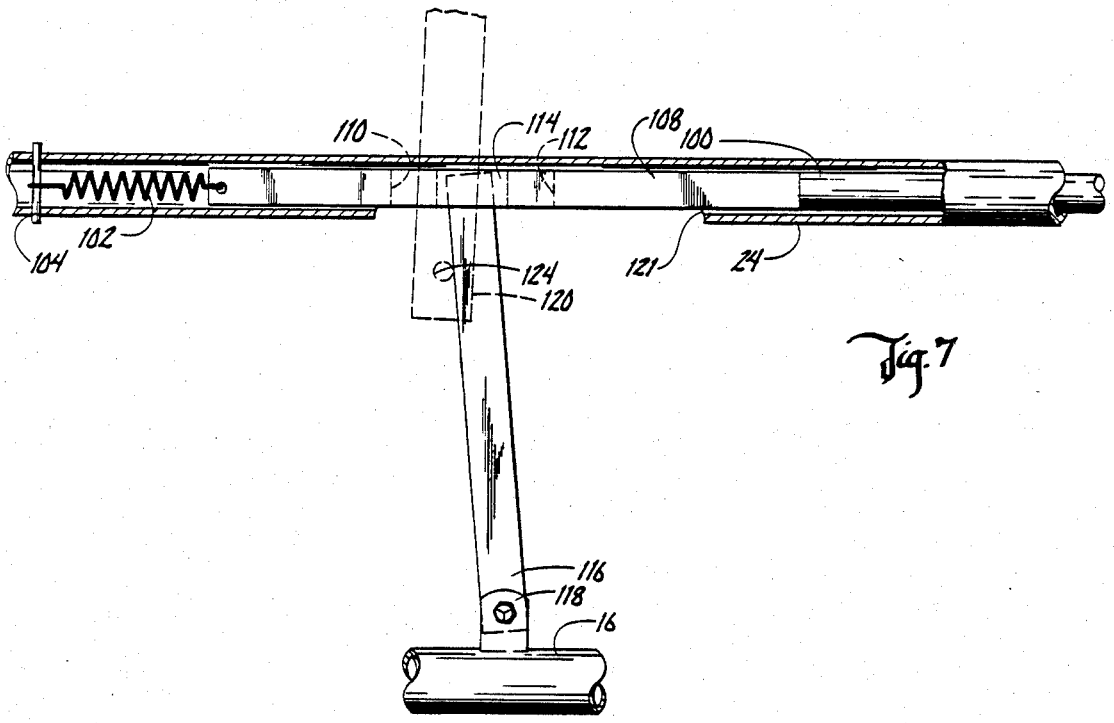

FIG. 6 shows that the inner end of latch bar 100 includes a pair of rigid straps 106 and 108 secured together at their inner ends and having a pair of spacer blocks 110 and 112 secured between them to define a slot 114. Slot 114 receives the upper end of a latch arm 116, the lower end of which is pivotally connected to a clevis 118 on the gate bottom rail 16. The underside of intermediate rail 24 has an elongated slot 121 to accommodate back and forth pivotal movement of latch arm 116.

A latch operator lever 120 is pivotally connected to intermediate rail 22 at 122. A lower end of lever 120 carries a pin 124 which engages the inner edge of latch arm 116. The upper end of lever 120 carries a pivotal sleeve 126 which is adjustably connected to a latch rod 128 by a set screw 130. The outer end of latch rod 128 is secured to a depending flange 131 on a latch slide 132, shown in detail in FIG. 2. Latch slide 132 resembles trolley slide 64 and is slidable on track 40 except that it is not connected to drive chain 94.

Figure 3:
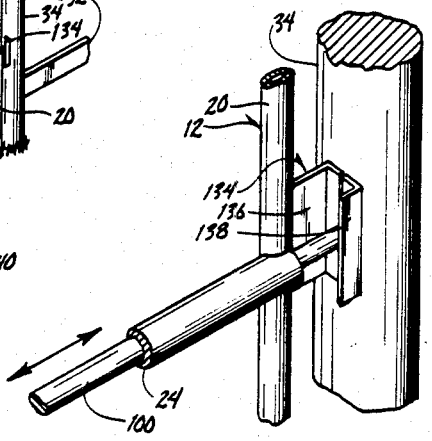
FIG. 3 is an enlarged partial detail perspective view of the gate latch engaging the latch receiving bracket on the closure post.

In FIGS. 3 and 4, it is seen that the outer end of latch bar 100 coacts with a latch receiving bracket 134 on closure post 34 to latch gate 12 in its closed position. Bracket 134 includes spaced-apart flanges 136 and 138 for retaining the latch bar 100 between them. Flange 136 is longer than flange 138 to act as an abutment surface for limiting closing movement of the gate to its closed position adjacent closure post 34.

The operation of the latching mechanism is as follows. When drive motor 84 is actuated to retract trolley 42 to the dotted line gate closed position indicated in FIG. 4, upstanding tab 66 engages the upper flange of latch slide 132. Note that set screw 130 enables longitudinal adjustment of the latch slide and latch rod 128 so that they are properly positioned. Continued actuation of motor 84 produces an overtravel retracting movement of trolley 42 thereby pushing trolley slide 64 to the left as indicated in FIG. 4. This produces a counterclockwise rotation of lever 120 which rocks latch arm 116 to the right, thereby advancing latch bar 100 outwardly to its latched position against the urging of spring 102. A limit switch deactivates drive motor 84 upon latching of the gate.

To open the gate, drive motor 84 is actuated to advance trolley 42 from its latched position back to its dotted line gate closed position in FIG. 4. This movement enables spring 102 to retract latch bar 100 for unlatching the gate. Continued advancing movement of trolley 42 causes the gate to swing to its open dotted line position in FIG. 1 as indicated by arrow 140.

Some type of slack adjustment means must be provided to take up the overtravel retracting movement of the trolley when the gate is being latched to prevent binding of the control arm 44 and to enable the gate 12 to remain in its closed position. For this purpose, control arm 44 is compressible.

Figure 8:
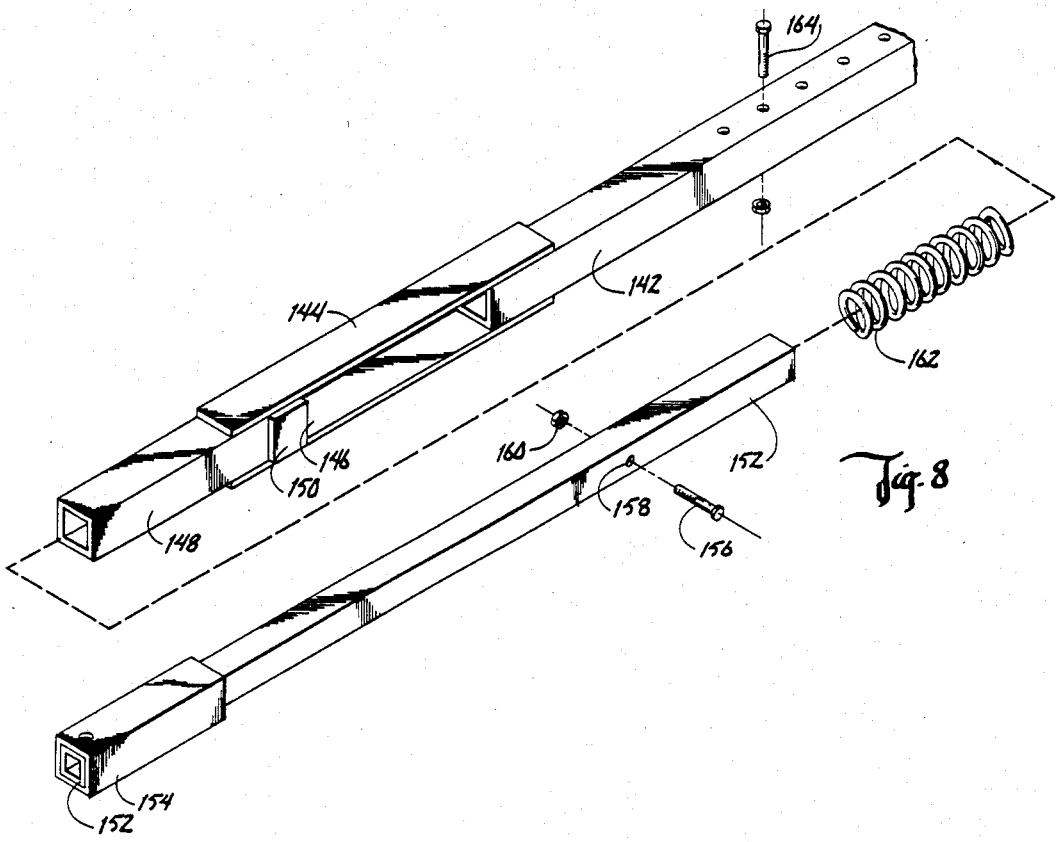
FIG. 8 is an exploded perspective view of the compressible control arm.
Figure 9:
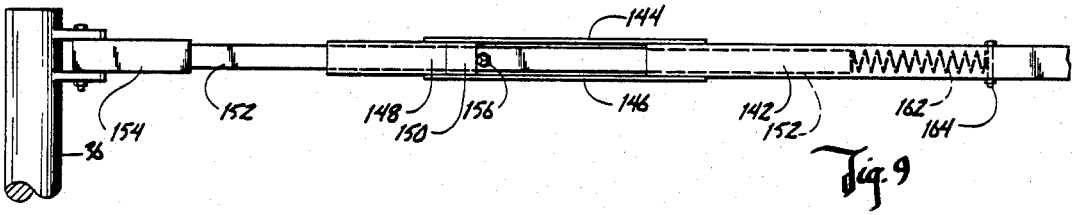
FIG. 9 is a partial side view of the control arm in its normally expanded condition.
Figure 10:
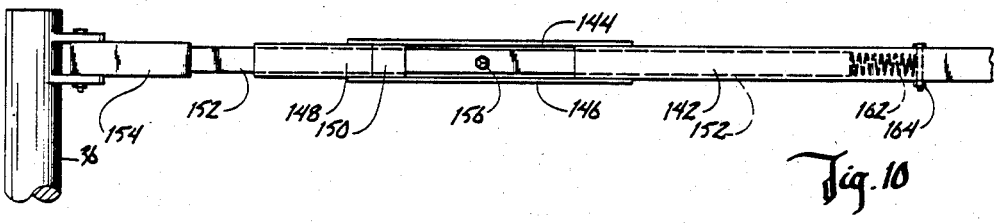
FIG. 10 is a partial side view of the control arm in its compressed gate latched condition.

Referring to FIG. 8, control arm 44 includes an elongated square section tube 142 connected by top and bottom extension plates 144 and 146 to an outer tube portion 148 having a stop plate 150 secured to the inner end thereof. A smaller square section tube 152 is slidably received within tubes 148 and 142. The free end of tube 152 has a tube portion 154 secured thereon for added strength. When tube 152 is inserted into tube 142, a bolt 156 is inserted through a hole 158 and secured by nut 160. Accordingly, sliding movement of inner tube 152 is limited by engagement of the bolt head 156 with tube 142 and stop plate 150. A compression spring 162, however, is inserted into tube 142 into engagement with a stop pin 164. Compression spring 162 operates to bias inner tube 152 outwardly so that bolt 156 normally is engaged against stop plate 150 as indicated in FIG. 9. Overtravel retracting movement of trolley 42, however, operates to compress the control arm 44 against the urging of spring 162 as shown in FIG. 10.

Thus there has been shown and described in automatic gate assembly which accomplishes at least all of the stated objects.

I claim:

1. An automatic gate assembly, comprising an elongated gate having top and bottom edges and opposite ends, means hingedly suporting one end of said gate for swinging movement of the gate between open and closed positions, a control arm post secured to the ground at a position in spaced relation from the plane of said gate in its closed position, a trolley, track means on said gate for supporting said trolley for movment longitudinally of said gate, drive means on said gate for advancing and retracting said trolley in opposite directions along said track means, an elongated control arm having one end pivotally connected to said trolley and an opposite end pivotally connected to said control arm post such that said gate is constrained to swing to its open position in response to advancing movement of said trolley to a gate open position and to swing to its closed position in response to retracting movement of the trolley to a gate closed position, a latch supported on the opposite end of the gate for movement between latched and unlatched positions, means for moving said latch to the latched position in response to overtravel retracting movement of the trolley beyond said gate closed position, and slack adjustment means for taking up said overtravel retracting movement of the trolley so the gate will remain in its closed position while being latched said slack adjustment means comprising means for shortening the length of said control arm.

2. The automatic gate assembly of claim 1 wherein said track means and drive means are positioned on said gate above the top edge thereof.

3. The automatic gate assembly of claim 1 wherein said drive means comprises a pair of sprockets rotatably supported on the gate in longitudinally spaced-apart relation, a drive chain trained about said sprockets and secured to said trolley, and a power means on the gate for rotating one of said sprockets.

4. The automatic gate assembly of claim 1 wherein said control arm comprises an outer arm portion, an inner arm portion telescopically received in said outer arm portion and means for limiting telescopic movement therebetween in both directions.

5. The automatic gate assembly of claim 4 further comprising bias means on said control arm operative to urge said telescoping arm portions apart to an outer limit position therefor.

6. The automatic gate assembly of claim 5 wherein said bias means comprises a compression spring situated within said outer arm portion and further comprising stop means for limiting movement of said compression spring in a direction away from said inner arm portion.

7. The automatic gate assembly of claim 1 further comprising an upright closure post secured in the ground adjacent the opposite end of said gate in its closed position, said closure post including a latch receiving bracket into which said latch is received in its latched position.

8. The automatic gate assembly of claim 7 wherein said latch receiving bracket includes spaced-apart upright abutment surfaces, said latch being situated between said abutment surfaces in its latched position to retain said gate in its closed position.

9. The automatic gate assembly of claim 8 wherein said latch receiving bracket further comprises abutment means positioned for engagement by said gate in the closed position thereof to limit closing movement of said gate to the closed position thereof.

10. An automatic gate assembly, comprising an elongated gate having top and bottom edges and opposite ends, means hingedly supporting one end of said gate for swinging movement of the gate between open and closed positions, a control arm post secured to the ground at a position in spaced relation from the plane of said gate in its closed position, a trolley, track means on said gate for supporting said trolley for movement longitudinally of said gate, drive means on said gate for advancing and retracting said trolley in opposite directions along said track means, an elongated control arm having one end pivotally connected to said trolley and an opposite end pivotally connected to said control arm post such that said gate is constrained to swing to its open position in response to advancing movement of said trolley to a gate open position and to swing to its closed position in response to retracting movement of the trolley to a gate closed position, a latch supported on the opposite end of the gate for movement between latched and unlatched positions, means for moving said latch to the latched position in response to overtravel retracting movement of the trolley beyond said gate closed position, and slack adjustment means for taking up said overtravel retracting movement of the trolley so the gate will remain in its closed position while being latched, said latch comprising an elongated latch bar, and further comprising means for longitudinally slidably supporting said latch bar on the gate, said means for moving said latch comprising a generally upright pivot lever having a lower end operatively connected to said latch bar and an upper end adjacent said track means whereby retracting movement of said upper end toward said one end of the gate results in advancing movement of the latch bar to its latched position.

11. The automatic gate assembly of claim 10 further comprising bias means on said gate for urging said latch bar to the unlatched position.

* * * * *